US006713691B2

(12) United States Patent
Sakai et al.

(10) Patent No.: US 6,713,691 B2
(45) Date of Patent: Mar. 30, 2004

(54) SOFT-FEELING OPERATION SWITCH

(75) Inventors: Naohiro Sakai, Tsurugashima (JP); Tatsuya Itakura, Wako (JP)

(73) Assignees: Toyo Denso Kabushiki Kaisha, Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/418,240

(22) Filed: Apr. 17, 2003

(65) Prior Publication Data

US 2003/0230473 A1 Dec. 18, 2003

(30) Foreign Application Priority Data

Apr. 18, 2002 (JP) ..... 2002-153127

(51) Int. Cl.[7] ..... H01H 9/02
(52) U.S. Cl. ..... 200/5 A; 200/512
(58) Field of Search ..... 200/5 A, 512–517; 428/332, 334, 423.1, 425.5

(56) References Cited

U.S. PATENT DOCUMENTS 5,556,668 A * 9/1996 Chun ..... 427/378
5,804,299 A * 9/1998 Nakata et al. ..... 428/334
6,451,143 B2 * 9/2002 Nishi ..... 156/82

* cited by examiner

*Primary Examiner*—Michael A. Friedhofer

(57) ABSTRACT

An operation switch having an operation surface with a specified pattern printed thereon and covered with a soft-feeling layer of paint, which can obtain the increased durability of adhesion between the pattern-printed surface and the soft-feeling coat of paint by adopting a simple technical means and can withstand repeated finger-pressing operations for a long period of service life without stripping the soft-feeling layer from the pattern-printed surface. This is achieved by first printing a specified pattern on the operation substrate surface of the switch by using siliconeless ink or a two-component isocyanate setting type urethane ink and then covering the pattern-printed surface with a coat of a transparent or semitransparent soft paint or by first coating and then printing.

18 Claims, 1 Drawing Sheet

SOFT-FEELING OPERATION SWITCH

BACKGROUND OF THE INVENTION

The present invention relates to an operation switch having an operation surface area with a specified pattern printed thereon and, more particularly, to a soft-feeling operation switch allowing a user to operate it feeling a pleasant soft touch.

Japanese Utility Model Publication No. 2597852 discloses a conventional switch developed as a membrane switch being a soft-touch key used for a telephone dial button, which has a plastic film substrate surface with a pattern printed thereon and covered with a transparent paint coat being soft to the touch.

However, this type of operation switches having a pattern-printed surface with a coat of soft-feeling paint to be soft to the touch may have such a disadvantage that repeated finger-pressure operations may cause the coat layer to become loose and separated from the pattern-printed layer because the latter layer formed by a printing ink material contains silicone as an anti-cracking agent thereby reducing the adhesion of the coat layer thereto. In other words, the switch may have the decreased durability of the soft-feeling coat against the repeated finger-pressure operations.

To prevent the separation of the coated layer from the pattern-printed surface, there has been developed a switch having a surface with a specified pattern printed by laser etching and covered with a soft-feeling coat of paint.

As described above, the common problem of the conventional soft-feeling switches of the type having a pattern-printed surface with a soft-feeling coat formed thereon is low durability of their soft-feeling coat that may become loose and peel off by repeatedly pressing it by the user's finger during the operation period because of insufficient adhesion between the pattern-printed surface and the soft-feeling coat of paint.

On the other hand, drawbacks of the conventional switch having a specified pattern printed by laser etching on its operation surface and then covered with a soft-feeling paint coat is that it is expensive to manufacture by using a laser etching equipment and may be of larger unevenness of its surface in comparison with a switch having a surface first coated with a soft-feeling paint and then pattern-printed thereon.

SUMMARY OF THE INVENTION

Accordingly, an object of the present invention is to provide an operation switch having an operation surface with a specified pattern printed thereon, which is capable of withstand repeated finger-touch operations for a long service time without loosening and separating a soft-feeling layer (a coat of soft paint) from the pattern-printed surface of its substrate (base material) owing to the high strength and durability of the interlayer adhesion achieved by first printing the specified pattern on the substrate by using a siliconeless printing ink (i.e. a printing ink without silicone as an ingredient) and then applying thereon a soft-feeling coat of a transparent or semitransparent soft-painting material.

Another object of the present invention is to provide an operation switch having an operation surface with a specified pattern printed thereon, which is capable of withstand repeated finger-touch operations for a long service time without loosening and separating the pattern-printed layer from a soft-feeling layer (a coat of soft paint) of its substrate (baste material) owing to the high strength and durability of the interlayer adhesion achieved by first covering the substrate surface with a soft-feeling layer of soft painting material and then printing thereon the specified pattern by using a siliconeless printing ink.

Another object of the present invention is to provide an operation switch having an operation surface with a specified pattern printed thereon, which is capable of withstand repeated finger-touch operations for a long service time without loosening and separating a soft-feeling layer from the pattern-printed surface of its substrate owing to the high strength and durability of the interlayer adhesion achieved by first covering the substrate surface with a soft-feeling layer of a transparent or semitransparent soft painting material and then printing thereon the specified pattern by using a two-component isocyanate setting type urethane ink.

Another object of the present invention is to provide an operation switch having an operation surface with a specified pattern printed thereon, which is capable of withstand repeated finger-touch operations for a long service time without loosening and separating the pattern-printed layer from a soft-feeling layer (a coat of soft paint) of its substrate (base material) owing to the high strength and durability of the interlayer adhesion achieved by first covering the substrate surface with a soft-feeling layer of soft painting material and then printing thereon the specified pattern by using a two-component isocyanate setting type urethane ink ink.

PREFERRED EMBODIMENTS OF THE INVENTION

The present invention is directed to vehicle-mounted device switches such as for example a power window switch and a combination switch, which switches are featured by indication of their objects in terms of a picture, symbol or/and letter printed on their top surfaces.

Figure 1:
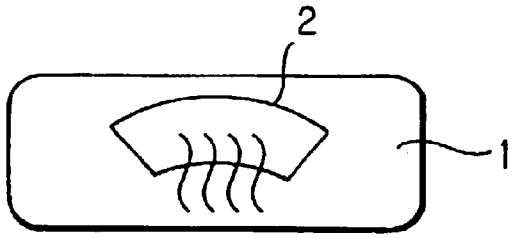
FIG. 1 is a plan view of an exemplary soft-feeling operation switch.
Figure 2:
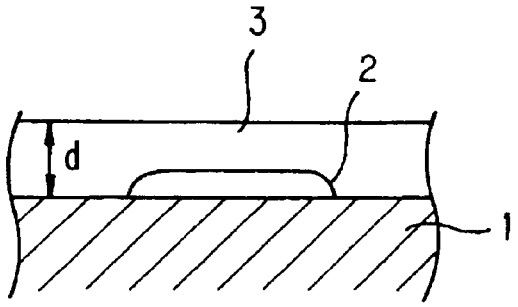
FIG. 2 is a fragmentary sectional front view of a soft-feeling operation switch according to an embodiment of the present invention.

In FIG. 1, there is shown a soft-feeling operation switch according to the present invention, which is for example a touch key type switch for ON-OFF operation of a rear defroster. As shown in FIG. 2, this operation switch has a substrate surface 1 (operation surface) with a pattern 2 being an illustration of a "Fog Lamp" printed thereby by using an image-transferring elastic pad with a two-component isocyanate setting type urethane ink and further coated with a soft-feeling layer 3 of a transparent or semitransparent soft polyurethane paint.

The shown construction of the switch can allow a user to feel a pleasant soft touch when pushing it by his or her finger. The pattern-printed layer 2 formed by a siliconeless printing ink or a two-component isocyanate setting type urethane ink can durably adhere to the soft-feeling layer 3 which can therefore withstand repeated pressing operations for a long service life without separating the soft-feeling layer 3 from the printed pattern 2.

Figure 3:
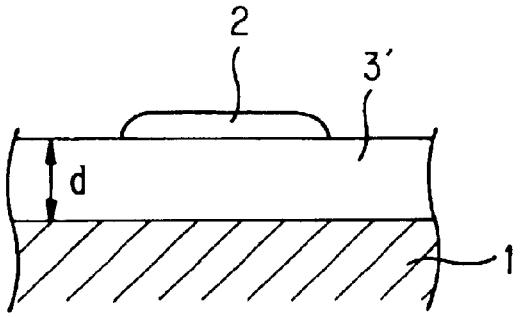
FIG. 3 is a fragmentary sectional front view of a soft-feeling operation switch according to another embodiment of the present invention.

The soft-feeling operation switch according to the present invention has, as shown in FIG. 3, an operating substrate surface 1 on which a soft-feeling layer 3' of polyurethane soft paint is first coated and a specified pattern 2 is then printed on the coated layer by using an image-transferring elastic pad with a siliconeless ink or a two-component isocyanate setting type urethane ink.

This soft-feeling operation switch allows a user to feel a pleasant soft touch to operate and assures the strong and durable adhesion between the printed pattern 2 and the soft-feeling layer 3'. In this aspect, the soft-feeling layer 3' can be of any desirable color of paint.

In case that the substrate 1 of the operation switch is made of synthesized resin being poor to adhere to the soft-feeling paint, it is necessary to previously apply a primary coat of acryl paint on the substrate surface to obtain the necessary adhesion to the soft-feeling paint layer to be applied thereon.

It is necessary for the soft-feeling operation switch to possess a good appearance in addition to being soft to the touch to achieve both requirements, it is important to select an adequate thickness of the soft-feeling layer 3 or 3'

The thickness "d" of the soft-feeling layer 3 or 3' is of 25 to 50 microns which is optimal to acquire the excellent feeling quality and wear resistance by the JIS (Japanese Industrial Standard) tests for estimating the adaptability of products to mass production.

If the soft-feeling layer 3 or 3' of the switch has a thickness "d" of less than 25 microns, it may not be soft to the touch. If the soft-feeling layer of the switch has thickness "d" of more than 50 microns, this layer, which is a film formed by soft paint on the substrate of the switch, may become fragile and crazed by the stress caused by repeated finger-pressing operations.

As is apparent from the foregoing, the operation switch having a specified pattern-printed operation surface according to the present invention, wherein the specified pattern is printed with siliconeless ink or a two-component isocyanate setting type urethane ink first on the operating surface of the substrate and then covered with a transparent or semitransparent coating layer of soft paint thereon or the coating layer of soft paint is first applied on the substrate surface and then the specified pattern is printed thereon with siliconeless ink or a two-component isocyanate setting type urethane ink, can offer the advantage of effectively increasing the strength and durability of adhesion between the pattern-printed surface and the soft-feeling layer by a simple way and effectively preventing the occurrence of separating of the soft-feeling layer from the pattern-printed surface resulting from repeated finger-pressing operations.

What is claimed:

1. A soft-feeling operation switch having a specified pattern printed on an operation surface, wherein the specified pattern is printed with siliconeless printing ink on the operation surface of a substrate (base material) of the switch and said pattern-printed surface is covered with a layer of a transparent or semitransparent soft paint.

2. A soft-feeling operation switch having a specified pattern printed on an operation surface, wherein a layer of soft paint is first applied onto the operation surface of a substrate of the switch and the specified pattern is then printed thereon with siliconeless printing ink.

3. A soft-feeling operation switch having a specified pattern printed on an operation surface, wherein the specified pattern is printed with printing ink of a two-component isocyanate setting type urethane on the operation surface of a substrate of the switch and said pattern-printed surface is then covered with a layer of a transparent or semitransparent soft paint.

4. A soft-feeling operation switch having a specified pattern printed on an operation surface, wherein a layer of soft paint is first applied onto the operation surface of a substrate of the switch and the specified pattern is then printed thereon with printing ink of a two-component isocyanate setting type urethane.

5. A soft-feeling operation switch as defined in any one of claims 1 to 4, characterized in that the paint is of polyurethane resin.

6. A soft-feeling operation switch as defined in any one of claims 1 to 4, characterized in that the specified pattern is printed by the method of printing using an image-transferring elastic pad.

7. A soft-feeling operation switch as defined in any one of claims 1 to 4, characterized in that the paint layer is of 25 to 50 microns in thickness.

8. A soft-feeling operation switch as defined in any one of claims 1 to 4, characterized in that the substrate surface is coated with primer paint of acryl resin.

9. A soft-feeling operation switch having a specified pattern on an operation surface of a substrate of the switch, comprising, the specified pattern being printed with either siliconeless printing ink or a two-component isocyanate setting urethane ink, and a layer of soft paint, wherein one of either said printed specified pattern or said layer of soft paint is applied to the substrate of the switch and the other of said printed specified pattern or said layer of soft paint is applied over the one applied to the substrate.

10. A soft-feeling operation switch as defined in claim 9, characterized in that the specified pattern is printed on the substrate of the switch and said layer of soft paint is either transparent or semitransparent.

11. A soft-feeling operation switch as defined in claim 9, characterized in that the layer of soft paint is applied to the substrate of the switch and the specified pattern is then printed on the layer of soft paint.

12. A soft-feeling operation switch as defined in any one of claims 9, 10 and 11 characterized in that the paint is of polyurethane resin.

13. A soft-feeling operation switch as defined in any one of claims 9, 10 and 11 characterized in that the specified pattern is printed by the method of printing using an image-transferring elastic pad.

14. A soft-feeling operation switch as defined in any one of claims 9, 10 and 11 characterized in that the paint layer is of 25 to 50 microns in thickness.

15. A soft-feeling operation switch as defined in any one of claims 9, 10 and 11 characterized in that the substrate surface is coated with primer paint of acryl resin.

16. A soft-feeling operation switch as defined in claim 15, characterized in that the paint is of polyurethane resin.

17. A soft-feeling operation switch as defined in claim 16, characterized in that the specified pattern is printed by the method of printing using an image-transferring elastic pad.

18. A soft-feeling operation switch as defined in claim 17, characterized in that the paint-coated layer is of 25 to 50 microns in thickness.

* * * * *